US005135712A

United States Patent [19]

Kijima et al.

[11] Patent Number: 5,135,712

[45] Date of Patent: Aug. 4, 1992

[54] PROCESS FOR PRODUCING INJECTION-MOLDED SINTERINGS BY POWDER METALLURGY

[75] Inventors: Yoshio Kijima, Tokyo; Kazuo Iijima, Sagamihara; Masahiro Yokoo, Tokyo, all of Japan

[73] Assignee: Sumitomo Metal Mining Company Limited, Tokyo, Japan

[21] Appl. No.: 563,710

[22] Filed: Aug. 7, 1990

[30] Foreign Application Priority Data

Aug. 8, 1989 [JP] Japan ..... 1-203961

[51] Int. Cl.[5] ..... B22F 1/00; B22F 1/02

[52] U.S. Cl. ..... 419/36; 419/38; 264/22; 264/63; 264/328.2

[58] Field of Search ..... 264/63, 24, DIG. 58, 264/22, 328.2; 419/32, 36, 38

[56] References Cited

U.S. PATENT DOCUMENTS 4,544,985 10/1985 Metz et al. ..... 361/144

4,604,042 8/1986 Tanigawa et al. ..... 425/3

4,678,616 7/1987 Kawashima ..... 264/24

*Primary Examiner*—James Lowe

*Assistant Examiner*—Christopher A. Fiorilla

*Attorney, Agent, or Firm*—Watson, Cole, Grindle & Watson

[57] ABSTRACT

A process for producing an injection-molded sintered product by powder metallurgy includes injection molding a kneaded product including a magnetic powder and a binder, releasing the molded product from the metal mold, and sintering the molding after debindering, wherein the molding is taken out from the metal mold using an electromagnet which exerts an adsorptive force to the molding. The process simplifies the release of the injection-molded products from metal molds and the transfer of the molding to the debindering process. The process is suitable for mass production, gives high yield, and has a wide applicability to products regardless of their shape.

6 Claims, 1 Drawing Sheet

PROCESS FOR PRODUCING INJECTION-MOLDED SINTERINGS BY POWDER METALLURGY

FIELD OF THE INVENTION

The present invention relates to an advanced method for producing sintered products by powder metallurgy, using the injection molding method.

BACKGROUND OF THE INVENTION

Known methods for producing sintered products having complicated three-dimensional shapes include a process which comprises injection-molding a kneaded mixture comprising a powder and a binder, taking the molded product out of the mold, and sintering the molding after debindering.

Accordingly, the aforementioned process comprises a step of releasing the molded product from the mold, and this conventionally was done (1) manually, i.e., by hand or (2) using a robot, by either mechanically chucking the sprue of the molding, or holding the molding with a pad using an adsorptive force exerted by reducing pressure.

Those methods, however, each have their own disadvantages; a manual step is always a hindrance in scaling up production. The use of robots may possibly improve productivity, but in the former, it often was the case that the molded product which was still not sufficiently strong at the gate caused breakage to occur, and thereby the molding would drop off. Thus, this method suffered low yield. The later also comprises various problems, such as occasional fall off of the molding ascribed to the insufficient adsorptive force of the pad not withstanding the weight of the molding having high specific gravity; inapplicability to the moldings having curved faces where a tight contact between the molding and the pad is not achievable, or to the moldings having through holes, where the reduced pressure cannot be maintained; and a time- and power-consuming positioning of the pad at high precision to achieve effective function of the pad.

SUMMARY OF THE INVENTION

It is an object of the present invention to provide a method for taking out injection-molded products readily from metal molds and thereafter transporting the molding to the debindering process. Such a method is suitable for mass production, gives high yield, and has a wide applicability to products regardless of their shape.

The aforementioned object was accomplished by the process according to the present invention which comprises injection-molding a kneaded product comprising a magnetic powder and a binder, releasing the molding from the metal mold, and sintering the molding after debindering, wherein the molding is taken out from the metal mold using an electromagnet which exerts an adsorptive force to the molding.

DETAILED DESCRIPTION OF THE INVENTION

The powder for use in the present invention has no particular restriction as far as the powder is magnetic. Examples include powders of an iron alloy, nickel alloy, cobalt alloy, cemented carbide, and ferrite. Also included are those having no magnetism as a sintering but which are slightly magnetic as a powder, such as austenite-based stainless steel materials.

A powder as described above is then kneaded with a binder, and the resulting mixture is injection-molded to give a molding. This molding is then released from the metal mould using an electromagnet, which electromagnetically adsorbs the molded product. The use of an electromagnet is requisite, because it enables detachment of the molding at a predetermined position so that the molding can be transferred to the next step, whereas it exerts sufficient magnetic force to the molding in the case of releasing the molding from the metal mold.

It is preferred to carry out the aforementioned electromagnetic adsorption, transfer, and electromagnetic release operations in sequence, by using a robot having the operations programmed in terms of electrical on-offs of the electromagnet in the sequential circuit thereof. In this way, injection molding can be carried out in due time without delay of the cycle time dependently of the mold release, thus, the products can be obtained with higher productivity.

Further, an advantageous point of the process according to the present invention is the applicability of the process to a wider variety of products, independent of their shape. The prior art process using a pad required that the molded product had a flat area of not less than about 5 mm. The present process, on the other hand, has no such restrictions and is applicable to moldings, e.g. having not more than 5 mm by area, and is even applicable to ring-shaped ones, those having a through hole or a curved face, and the like.

Also possible in the present process is to change the magnetic force of the electromagnet by simply replacing the magnet with a more powerful or a less powerful one, or by controlling the electric current applied to the electromagnet. That is, the adsorptive force is readily controlled and therefore the method can be tailored according to the weight of the molding. Therefore, the fall-off of the molding during its release from the mold and transportation to the debindering step is avoided, and thus, the product yield can be improved.

The rearranging operation upon change of the mold is simple; it only requires that the position of the electromagnet is adjusted to the center of the cavity. This is far convenient as compared with the prior art process using a pad, concerning that the pad process required preliminary test steps to determine the pad position with high precision.

Now the invention is illustrated in further detail with reference to Examples and Comparative Examples. Unless otherwise indicated, all the parts, percents, and ratios are expressed by weight.

EXAMPLE 1

Figure 1:
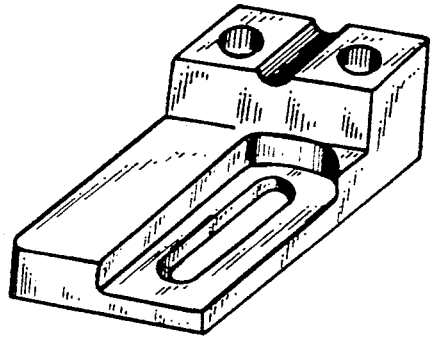
FIGS. 1 and 2 are each oblique views of the molded components produced by the method according to the present invention and by conventional methods.

Ten kilograms of a mixture having 92:8 weight ratio of an iron carbonyl powder (5 μm in average particle diameter) and an organic binder was kneaded in a compact kneader, which was then injection-molded to give a molded component (10 mm wide, 16 mm long, and 4 mm high; with a weight of 4.5 g) of a guitar as shown in FIG. 1. The molded product was released from the mold by operating an ejector pin while simultaneously adsorbing the mold with an electromagnet fixed on an aluminum-made attachment of a traversely running robot, and the molding taken out from the metal mold to the outside of the molding machine was detached on a conveyor belt. These mold-releasing and transportation operations were made automatically with a cycle time of 15 seconds. Adsorption failure occurred only once out of continuous 1500 operations.

EXAMPLE 2

Figure 2:
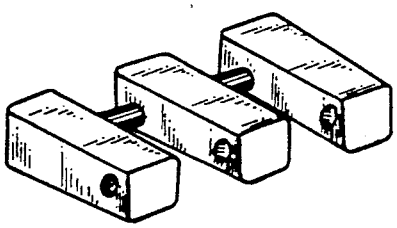

A molded component (12 mm long, 6 mm wide, and 2 mm high; with a weight of 1.2 g) for a wrist watch band as shown in FIG. 2 was obtained in the same manner as described in Example 1, except for using a different metal mold and changing the starting material to a mixture having 93:7 weight ratio of an SUS 316 powder (consisting of gas-atomized spherical grains 14 um in average diameter) and an organic binder. This molded component was adsorbed with the apparatus equipped with the same electromagnet as used in Example 1, and was safely delivered on the conveyor belt. Mal-adsorption at the mold-released counted only once out of 1500 operations, as in Example 1.

COMPARATIVE EXAMPLE 1

The same operation as in Example 1 using the traversely running robot was conducted, except for fixing a pad 5 mm in diameter on the aluminum-made attachment of the robot. This trial, however, was in vain, since the pad was too large for the flat surface of the molding and caused air leakage.

The same operation was then conducted using a smaller pad 3 mm in diameter. This time also resulted in failure, since the adsorption force of the pad was insufficient that the molding fell off at a shock during the transport operation.

COMPARATIVE EXAMPLE 2

The same operation as in Example 2 was conducting using the traversely running robot, except for fixing an air cylinder on the aluminum-made attachment to thereby hold the molded product by mechanically checking the sprue part. It happened, however, to break at the gate, and it turned out that the molding fell off and broke out.

Thus, the process according to the present invention provides a simple method for transporting injection-molded magnetic products from the metal mold to the debindering process with high reliability. The present method using an electromagnetic adsorptive force is of great effect in improving productivity of injection-molded sinterings in powder metallurgy, since it is widely applicable to a variety of molded products regardless of the material used therein or of the shape thereof, and is applicable to a metal mold from which a plurality of moldings are obtained at the same time. Further, its structure is simple, is almost free from supporting problems and brings about good economy.

While the invention was described in detail referring to examples and comparative examples, it should be understood to one skilled in the art that various changes and modifications can be made thereof without departing the scope of the present invention.

What is claimed is:

1. A process for producing a non-magnetic injection-molded sintered product by powder metallurgy, which comprises:

injection molding a kneaded product comprising an austenite-based stainless steel and a binder, in a metal mold;

releasing the molded product from the metal mold; and sintering the molded product after debindering so that said product exhibits substantially no magnetism, wherein the molded product is taken out of the metal mold using an electromagnetic which exerts an adsorptive force on the molded product.

2. The process as claimed in claim 1, wherein the electromagnetic adsorption, transfer, and electromagnetic release operations of the molding are carried out in sequence, by using a robot having the operations programmed in terms of electrical on-offs of the electromagnet in a sequential circuit thereof.

3. A process for producing a non-magnetic injection-molded sintered product by powder metallurgy, which comprises:

injection molding into a metal mold a kneaded product comprising an austenite-based stainless steel and a binder;

exerting an adsorptive force on the molded product with an electromagnet;

releasing the molded product from the metal mold using the electromagnet;

debindering the molded product; and sintering the molded product after debindering so that said product exhibits substantially no magnetism.

4. The process as claimed in claim 3, wherein the electromagnetic adsorption, transfer, and electromagnetic release operations of the molding are carried out in sequence, by using a robot having the operations programmed in terms of electrical on-offs of the electromagnet in a sequential circuit thereof.

5. A process for producing a non-magnetic injection-molded sintered product by powder metallurgy, which comprises:

forming a kneaded product comprising a slightly magnetic powder of an austenite-based stainless steel and a binder;

injection molding the kneaded powder in a metal mold to form a molded product;

exerting an adsorptive force on the molded product with an electromagnet having sufficient adsorptive force to hold the molded product;

releasing the molded product from the metal mold using the electromagnet;

transporting the molded product using the electromagnet to a predetermined position;

detaching the molded product from the electromagnet at said predetermined position;

debindering said molded product; and sintering said molded product to form a sintered product exhibiting no magnetism.

6. The process as claimed in claim 5, wherein the electromagnetic adsorption, transfer, and electromagnetic release operations of the molding are carried out in sequence, by using a robot having the operations programmed in terms of electrical on-offs of the electromagnet in a sequential circuit thereof.

* * * * *